US008602785B2

(12) United States Patent
Jensen et al.

(10) Patent No.: US 8,602,785 B2
(45) Date of Patent: Dec. 10, 2013

(54) SMART MAGAZINE FOR SIMULATED WEAPON

(76) Inventors: Rick Allen Jensen, North Prairie, WI (US); Jared Russel Orvis, Bountiful, UT (US)

( * ) Notice: Subject to any disclaimer, the term of this patent is extended or adjusted under 35 U.S.C. 154(b) by 78 days.

(21) Appl. No.: 13/293,404

(22) Filed: Nov. 10, 2011

(65) Prior Publication Data

US 2012/0122058 A1 May 17, 2012

Related U.S. Application Data

(60) Provisional application No. 61/414,721, filed on Nov. 17, 2010.

(51) Int. Cl.
*F41A 33/00* (2006.01)

(52) U.S. Cl.
USPC ..... 434/18; 434/11

(58) Field of Classification Search
USPC ..... 434/11–27; 42/106; 124/73–77; 463/49–57
See application file for complete search history.

(56) References Cited

U.S. PATENT DOCUMENTS

| | | | | |
|---|---|---|---|---|
| 4,481,862 | A | 11/1984 | Wiethoff et al. | |
| 5,947,738 | A | 9/1999 | Muehle et al. | |
| 6,146,141 | A | 11/2000 | Schumann | |
| 6,682,350 | B2 | 1/2004 | Kehl et al. | |
| 6,869,285 | B1 | 3/2005 | Jones, II | |
| 7,291,014 | B2 | 11/2007 | Chung et al. | |
| 7,306,462 | B2 | 12/2007 | Metcalfe et al. | |
| 2003/0195046 | A1 | 10/2003 | Bartsch | |
| 2005/0260545 | A1 | 11/2005 | Schavone | |
| 2008/0127538 | A1 | 6/2008 | Barrett | |
| 2008/0187888 | A1 | 8/2008 | Jones et al. | |
| 2009/0253103 | A1 * | 10/2009 | Hogan, Jr. | 434/24 |
| 2010/0003643 | A1 | 1/2010 | Seo | |

FOREIGN PATENT DOCUMENTS

| | | | |
|---|---|---|---|
| DE | 202005004362 | UI | 7/2005 |
| GB | 2259559 | A | 3/1993 |
| WO | 2010065124 | A1 | 6/2010 |

* cited by examiner

*Primary Examiner* — Timothy A Musselman
(74) *Attorney, Agent, or Firm* — Boyle Fredrickson S.C.

(57) ABSTRACT

A smart magazine adapted to be releasably engaged with a simulated weapon is provided, the magazine comprising a housing, a valving mechanism disposed within the housing and a data module including an electronic storage medium for storing information concerning an amount of simulated ammunition "shots" present in the magazine, and a connection member operably connected to the data module and adapted to be operably connected to a control module in the weapon to transmit and receive signals in response to the firing of the weapon to adjust the number of "shots" stored in the storage medium. The magazine utilizes a compressed gas cartridge that releases gas to produce an audible "pop" when the weapon is fired and to reset the "shot" count for the magazine when the canister is replaced.

18 Claims, 5 Drawing Sheets

SMART MAGAZINE FOR SIMULATED WEAPON

CROSS-REFERENCE TO RELATED APPLICATIONS

This application claims priority from U.S. Provisional Application Ser. No. 61/414,721, filed on Nov. 17, 2010, the entirety of which is hereby expressly incorporated herein by reference.

FIELD OF THE INVENTION

The present invention relates to a weapon simulation system having simulated weapons with simulated ammunition magazines, and, more particularly, to a magazine for use with a simulated weapon system that will keep track of the number of simulated rounds of ammunition that have been expended from the magazine, which also provides an easy mechanism for replacing a compressed gas cartridge within the magazine.

BACKGROUND OF THE INVENTION

When military and/or police personnel or other individuals are engaged in tactical training situations, or playing games to simulate these types of situations, they use simulated weapons that are designed to imitate the size and feel of the actual firearms that are used in the field. Such firearms frequently use detachable magazines, which typically require that the operator carry a number of magazines loaded with ammunition so that they can rapidly re-load their weapon as needed.

To provide a realistic experience when individuals use weapon simulator systems incorporating simulated weapons with simulated detachable magazines, weapon simulator systems have been designed so that the trainee or individual is able to carry a number of simulated magazines to be used with the simulated weapon. By using various different magazines, the operator is able to interchange these magazines with the simulated weapon, as required with actual firearms.

Further, the magazine includes a mechanism capable of storing information on the number of "shots" available within the magazine, such as the electronic counter mechanism disclosed in UK Published Patent Application No. GB 2,259,559A, or the wireless module disclosed in U.S. Pat. No. 7,291,014, which are each incorporated herein by reference in its entirety. Through various types connections formed between the mechanism in the magazine and the weapon, as the weapon tracks the number of shots fired from the weapon, the weapon can supply this information to the magazine to correspondingly adjust the available number of "shots" in the magazine until the available number of "shots" reaches zero. At that point the magazine becomes empty or depleted and the mechanism in the magazine prevents further operation of the weapon. This information can be retained in the mechanism by the magazine, such that the magazine cannot simply be removed and reinserted into the same or another weapon. Once depleted, the magazine must be recharged by connecting the magazine to a suitable charger. Other examples of magazines and weapons of this type are also shown in US Patent Application Publication No. US2008/0127538, which is incorporated herein by reference in its entirety.

However, while electronic-only weapon simulator systems of this type force the individual to exchange magazines during a training simulation or game environment based on criteria similar to that present when using real weapons (i.e., the limited number of rounds present in a given magazine), the simulated weapons suffer from certain drawbacks. First, the chargers required to recharge depleted magazines require an individual to remove themselves from the simulation to access a charger, which is necessarily connected to a power source, such as an electric outlet, outside of the simulation environment. Further, the weapons of this type do not provide any feedback to the individual in the manner of real weapons, or other simulated weapons designed to fire paintballs or other similar projectiles. Consequently, when the simulated weapons of the above types are fired, only electronically-generated sounds or movement, i.e., vibration, if any, are generated by the weapon as an indication of the simulated firing of the projectile. As a result of these issues, the realism of using the simulated weapon in these simulations is diminished.

To provide more realistic action to the individual using the simulated weapon, there are a number of prior art simulated weapons that include a supply of compressed gas, air or carbon dioxide ($CO_2$) within the weapon. The compressed gas supply can be externally connected to the simulated weapon, disposed directly within the simulated weapon as a simulated round to be fired, or a container held a compartment in the weapon, or within a magazine designed to be removably engaged with the weapon. In each case, the compressed gas supply is present to provide a recoil effect to the simulated weapon via a recoil mechanism operated by the compressed gas supply in response to the operation of a trigger on the weapon. Examples of weapons of this type include those disclosed in: U.S. Pat. Nos. 5,947,738; 6,146,141; 6,682,350; 6,869,285; and 7,306,462; US Patent Application Publication No. US 2008/0187888 and PCT Published Application No. WO 2010/065124 A1, each of which is incorporated by reference herein.

In U.S. Pat. No. 6,869,285 a retrofit pistol is disclosed in which the compressed gas supply is provided by a canister that is positioned directly within the handle for the pistol. The canister is positioned within a housing located in the magazine well in the handle and held therein by a threaded clamp that is turned with respect to the handle to secure or disengage the canister from the recoil mechanism.

In each of U.S. Pat. Nos. 6,146,141 and 6,682,350, weapons are disclosed in which the supply of compressed gas is held within a magazine engaged with the weapon. However, in each of these references the canister is omitted and the compressed gas is stored directly within a compartment of the magazine. When depleted, the magazine is removed from the weapon and connected to a separate gas supply in order to recharge the canister with the compressed gas used to operate the recoil mechanism.

While each of U.S. Pat. Nos. 6,146,141; 6,682,350 and 6,869,285 provides more realistic feedback to the individual as a result of the recoil provided by the compressed gas supply and recoil mechanism, each of these references omits any mechanism where the number of shots fired by the weapon can be recorded and retained in a storage mechanism within the magazine. Further, similar to the electronic-only weapons discussed previously, when the compressed gas supply for each of these references is depleted, the construction of the weapon does not allow for a ready resupply of the compressed gas to the weapon.

In PCT Published Application No. WO 2010/065124, the disclosure shows a simulated weapon with a compressed gas canister positioned within a magazine that is removable from the magazine well. To hold the canister within the magazine, as in U.S. Pat. No. 6,869,285, a cartridge engagement means including a threaded clamp is provided to secure or disengage the canister from a valve mechanism operated when the trigger of the weapon is depressed to supply gas from the canister to the recoil mechanism. Further, the magazine in this reference also includes a mechanism within the magazine that counts the number of "shots" fired by the weapon, and can operate to lock the weapon in an inoperable state when a predetermined number of "shots" has been reached. The magazine must then be removed from the weapon to reset the counting mechanism by depressing a switch on the magazine, such that the magazine can be returned to the weapon for continued use.

However, in this reference, similar to U.S. Pat. No. 6,869,285, the construction of the cartridge engagement means prevents the magazine from being readily recharged with compressed gas. Therefore, with regard to each of prior art simulated weapons discussed here, the individual is limited to the simulated ammunition supply held within the total number of magazines that are carried by the individual.

Therefore, it is desirable to develop a detachable simulated magazine for use in connection with a simulated weapon for use in various combat simulations that provides a realistic look, sound and feel to the operation of the magazine and weapon, as well as providing a more efficient and realistic manner for reloading the simulated magazine with simulated ammunition.

SUMMARY OF THE INVENTION

According to one aspect of the present invention, a simulated magazine for a simulated weapon is provided that includes a compartment therein for a compressed gas canister. The canister is operably and releasably interconnected to a memory module contained within the magazine that stores information relating to the simulated ammunition supplied by the canister present in the magazine. The memory module includes a reset switch that can be selectively operated by the replacement of the compressed gas canister to enable the memory module and magazine to be reset for additional use. The memory module is additionally operably connected to a control module within the simulated weapon when the magazine is engaged with the weapon in order to receive signals from the control module regarding the simulated shots fired, to correspondingly update the information in the memory module concerning the amount of simulated ammunition remaining in the magazine.

According to another aspect of the present invention, the simulated magazine includes a valving mechanism operably connected to the compressed gas canister. When the magazine is engaged with the weapon the valving mechanism is engaged with an operating mechanism for the weapon, including the trigger. As the trigger is operated and the simulated weapon is fired, the movement of the trigger operates the valving mechanism to dispense an amount of the gas from the canister to provide a popping sound corresponding to the firing of the weapon, similar to the sounds created by the firing of a conventional paintball marker or gun. In addition, the control module for the weapon transmits a signal to the memory module in the magazine to change the count of ammunition remaining in the magazine.

According to another aspect of the present invention, the magazine includes a lever connected to the magazine that functions to both enclose the compressed gas cartridge within the magazine and to quickly engage/disengage the cartridge from the valving mechanism within the magazine in order to replace an empty cartridge with a full cartridge.

Numerous other aspects, features, and advantages of the present invention will be made apparent from the following detailed description together with the drawings figures.

BRIEF DESCRIPTION OF THE DRAWINGS

The drawings illustrate the best mode currently contemplated of practicing the invention embodied by the present disclosure.

In the drawings.

DETAILED DESCRIPTION OF THE INVENTION

Figure 1:
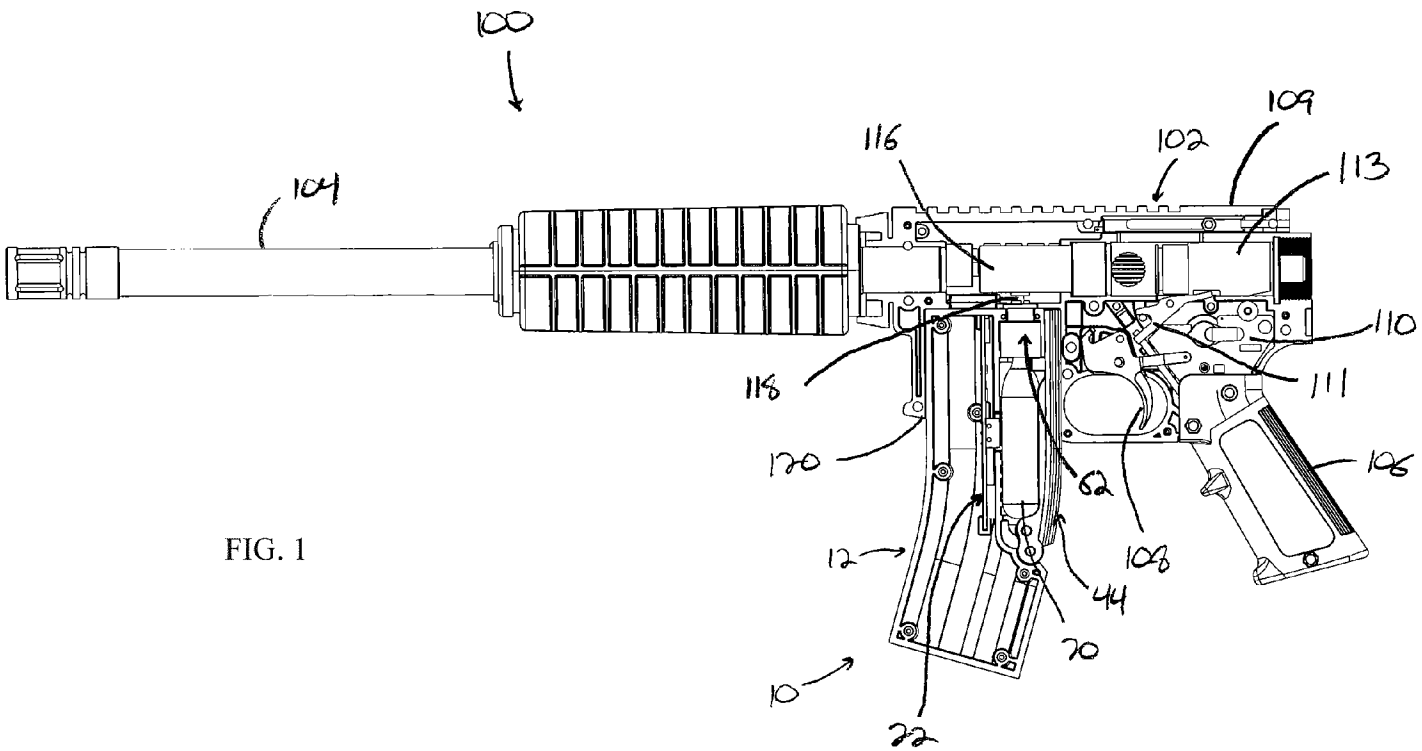
FIG. 1 is a cross-sectional view of a simulated magazine constructed according to the present disclosure engaged with a simulated weapon.

With reference now to the drawing figures in which like reference numerals designate like parts throughout the disclosure, in FIG. 1 a simulated magazine 10 is shown engaged with a simulated weapon 100. The weapon 100 can have any shape desired to simulate an actual weapon, and the magazine 10 can have a corresponding shape for use with the particular weapon 100.

In the illustrated embodiment, the weapon 100 includes a body 102, a barrel or muzzle 104 extending outwardly from one end of the body 102 and a handle 106 disposed on the body 102 generally opposite the barrel 104. Adjacent the handle 106 is a trigger 108 used to operate the weapon 100. The weapon 100 can be configured to fire any type of simulated or non-lethal ammunition, such as a line-of-sight signal, e.g., an infrared, LED or laser light beam, or a paintball, among other types of simulated ammunition.

The trigger 108 is operably connected to a control module 110 disposed within the body 102 that monitors the operation of the weapon 100 in order to provide signals of any suitable type to the user, optionally such as visual signals via a display 109 on the body 102, and to other individuals or systems regarding the status of the weapon 100, such as wireless signals sent to a remote CPU, among others. The control module 110 also is connected to a firing mechanism 112 located within the body 102. In the illustrated embodiment, the firing mechanism 112 operates the control module 110 when the trigger 108 is operated to "fire" a round of simulated ammunition from the weapon 100 through the barrel 104. The firing mechanism 112 can be formed as desired, and in the illustrated embodiment includes a sear 111 connected to the trigger 108, and a hammer 113 engaged with the sear 111. In operation, the activation of the trigger 108 causes the sear 111 and hammer 113 to move and operate the control module 110. When operated by the trigger 108, the control module 110 consequently and simultaneously sends out signals to a valve 116 having a stem 118 that extends outwardly from the valve 116 into a magazine sleeve or well 120 formed on the body 102 for interconnection with the magazine 10, and to a firing mechanism (not shown) of the weapon 100, which causes the line-of-sight signal or other simulated round to be "fired" out of the weapon 100. The sleeve 120 is shaped to correspond to the configuration for the magazine 10 to enable a secure fit between the sleeve 120 and the magazine 10. The sleeve 120 can also include a suitable locking mechanism (not shown) that is operable to lock the magazine 10 in place within the sleeve 120 until manually disengaged by the user when it is desired to remove the magazine 10 from the sleeve 120.

Looking now at FIGS. 1-6, in the illustrated embodiment the magazine 10 is constructed as a housing or shell 13 formed with a pair of halves 12 and 14 formed with apertures 15 therein, such as within channels 17 integrally formed on each half 12 and 14. The halves 12 and 14 can be formed from any suitable material, such as a metal or hard plastic, in order to withstand the repeated uses, similar to actual weapon magazines. To secure the halves 12 and 14 together to form the shell 13, the halves 12 and 14 can be positioned with the apertures 15 and channels 17 in each half 12 and 14 aligned with one another. In this position a number of fasteners 16 can be inserted through the apertures 15 and engaged with suitable engaging structures (not shown) located within the channels 17 in the halves 12 and 14 in any suitable manner. Alternatively, the shell 13 for the magazine 10 can be formed from a single component formed into the desired shape for the magazine 10 in any suitable manner.

One or both of the halves 12 and 14 may also include a display 30. The display 30 is operably connected to a data module 22 disposed within the magazine 10 and is operable to visually display the amount of simulated ammunition remaining within the magazine 10. While the display 30 can be disposed where desired on the magazine 10, in the illustrated embodiment the display 30 is located in a recessed position adjacent an engagement end 31 of the magazine 10 that is configured to be inserted within the sleeve 120 on the body 102 of the weapon 100. In this position, prior to insertion of the engagement end 31 within the magazine sleeve 120, the display 30 can illustrate to the user the amount of simulated ammunition remaining within the magazine 10. Once inserted within the sleeve 120, the display 30 is covered by the sleeve 120, preventing the display 30 from indicating the location of the weapon 100 and the user. Alternatively, the display 30 can be position where it is visible regardless of the engagement of the magazine 10 within the weapon 100, or the sleeve 120 can include a window (not shown) allowing the user to view the display 30 through the sleeve 120.

When assembled to form the magazine 10, the halves 12 and 14 define an interior 18 within which is disposed a compressed gas canister 20, and the data module 22. The canister 20, in one embodiment, is a standard carbon dioxide ($CO_2$) canister utilized in conventional paintball markers or guns. Different sized magazines 10 for different weapons 110 will allow the loading of between one (1) to four (4) standard twelve (12) gram canisters 20 containing liquefied $CO_2$ at a pressure of 600 psi to 1200 psi. The canister 20 includes a spout 60 at one end that can be punctured to enable the compressed gas in the canister 20 to exit the canister 20.

The data module 22 is formed in any desired manner and in any suitable configuration, and includes a circuit board 24 containing the operating circuitry for the module 22 that interconnects a suitable electronic memory or storage medium 25, such as a flash drive, a replaceable power supply 26, a reset switch 28 and a data connector 30. The board 24 is secured within the interior 18 of the magazine 10 by engaging opposed ends and sides of the board 24 within slots 32 formed on the interior portions of each half 12 and 14. When inserted within the slots 32, the switch 28 is positioned within an opening 33 in a peripheral wall 34 of the magazine 10 formed by the halves 12 and 14. The switch 28 includes a base 35 positioned on and operably connected to the circuitry on the board 24 and an arm 36 that extend though the opening 33 into a canister compartment 38. The remainder of the module 22 is maintained within the peripheral wall 34, such that the module 22 is protected from the elements within which the magazine 10 can be used.

The arm 36 of the reset switch 28 is physically contacted and activated by the removal and/or insertion of a compressed gas canister 20 into the compartment 38. When a new canister 20 is inserted into the compartment 38, the canister 20 engages the arm 36 of the switch 28, which sends a signal to the storage medium 25 on the data module 22. This signal indicates the presence of a new canister 20, which causes the storage medium 25 to reset to the maximum number of simulated "shots" allowed for the magazine 10. However, the reset switch 28 can alternatively be activated by other means, such as an electronic signal (wired or wireless) received by the data module 22 and storage medium 25 or the engagement of a special key (not shown) with the switch 28 among others.

The storage medium 25 is capable of storing and rewriting the number of simulated "shots" remaining in the magazine 10 during usage of the magazine 10. The storage medium 25 is formed from any suitable type of high usage, durable memory device, such as inexpensive devices that can powered by a separate power source or that do not require a separate power source, including, but not limited to flash memory devices, EEPORM (Electrically Erasable Programmable Read Only Memory) devices or FRAM (Ferroelectric Random Access Memory) devices, among others. The storage medium 25 can be set each game to have a certain maximum amount of shots per full magazine 10, e.g., an M-16 would have a maximum of thirty (30) simulated shots in the full magazine 10. Every time the simulated weapon 100 utilizing the magazine 10 fires a simulated "shot", the storage medium 25 subtracts one "shot" from this maximum amount. The storage medium 25 is also capable of maintain the stored data on the number of simulated "shots" fired from the magazine 10 when the magazine 10 is taken out of one weapon and put into another to use the remaining ammunition, as in a real life situation.

The data coupling or connector 30 is positioned within the magazine 10 adjacent the engagement end 31 and serves to relay signals between the storage medium 25 on the data module 22 and the control module 110 of the weapon 100. The connector 30 can take any suitable form, but in the illustrated embodiment is formed as a magnetic connector, capable of creating an electronic connection for transferring data between the data module 22 and the control module 110. The use of the magnetic data connector 30 enables the connector 30 to be housed entirely within the peripheral wall 34 of the magazine 10, preventing damage to the connector 30 by the elements or by the repeated engagement of the magazine 10 with the weapon 100. Signals identifying the number of simulated "shots" fired from the weapon 100 are transmitted from the control module 110 to the storage medium 25 on the data module 22 via the connector 30. The connector 30 is disposed adjacent the engagement end 31 of the magazine 10 that is inserted into the magazine sleeve 120 of the associated weapon 100, and is capable of transmitting and receiving signals from the control module 110 disposed within the weapon 100 that is used to monitor and control operation of the simulated weapon 100. For example, among other connections, the control module 110 is in communication with the trigger 108 to determine when the operator has attempted to fire the simulated weapon 100, as well as other electronics that may be used on or with the weapon 100, such as a laser emitter (not shown), a display (not shown) and a signal transceiver (not shown), among others. As a result, when the simulated magazine 10 is inserted into the weapon 100, the storage medium 25 and the data module 22 will be in electrical communication with the control module 110 in the simulated weapon 110 via the connector 30. The connector 30 is selected to be a very high use connection that will allow information to be read and written from the control module 110 to the storage medium 25 and vice versa. In addition, the magazines 10, in their intended usage, are often slammed into the weapon sleeve 120, so the magazines 10 and the components of the magazines 10 need to be very durable. In one embodiment, to provide enhanced durability, the connector 30 is formed as a magnetic connector so there is essentially no wear or tear on the connector 30 as it does not need to be in physical contact to operate, and thus does not need to be exposed in a potentially damaging position.

To provide power to the data module 22 and electronic storage medium 25, in the illustrated embodiment the power supply 26 for the board 24 is formed with a receptacle 40 for receiving a battery 42 therein. The battery 42 can be any suitable type of battery capable of providing the necessary voltage to the board 24, and can be selected to be easily replaceable when necessary. Further, the battery 42 supplies power to the data module 22 only when the magazine 10 is not connected with any weapon 100, as power can be supplied to the data module 22 from the weapon 100 via the connector 30 when the magazine 10 is engaged with the weapon 100. Thus, the effective useful life of the battery 42 is greatly extended. Additionally, other types of power supplied 26 can be used, such as by using supercapacitors or radio frequency induction processes and associated power storage mechanisms (not shown), among others.

Referring now to FIGS. 1, 2, and 4-6, the canister compartment 38 is selectively opened and closed by the operation of a pivoting cover 44 attached to the peripheral wall 34 of the magazine 10. The cover 44 has a first end 46 including an aperture 48 formed therein in which a pivot pin 50 is disposed. Opposite ends of the pin 50 are engaged within aligned apertures (not shown) in the compartment 38 to secure the pin 50 to the magazine 10.

Figure 5:
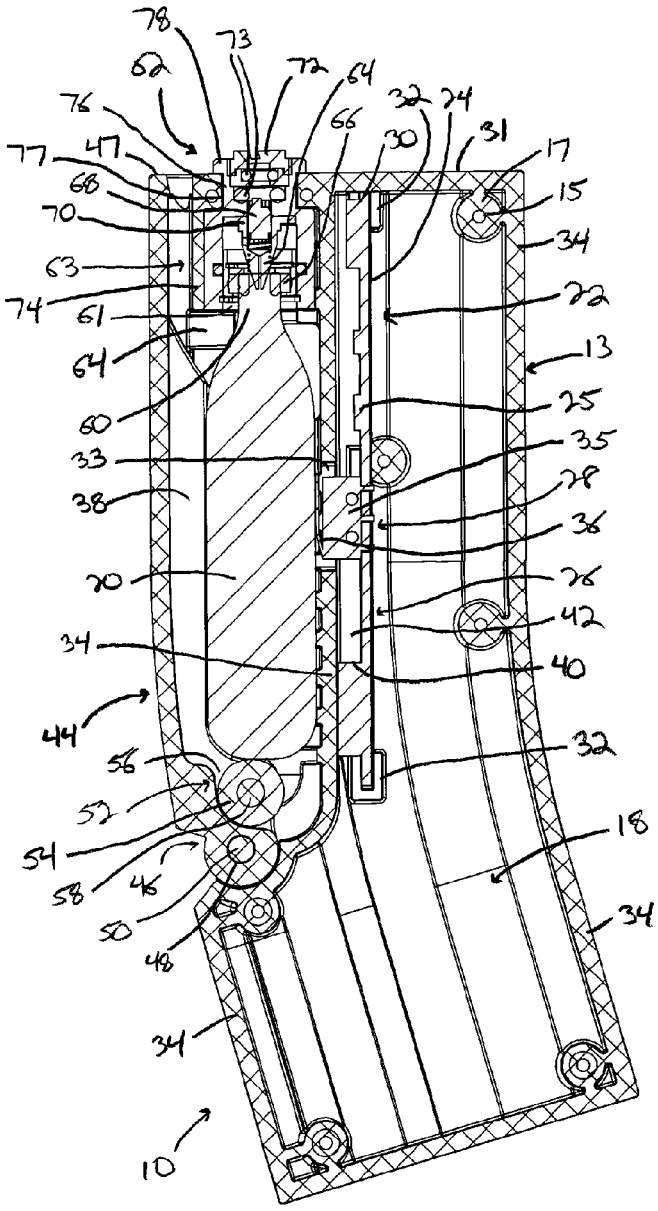
FIG. 5 is a cross-sectional view along line 5-5 of FIG. 4.

The first end 46 is formed with a cam 52 adjacent the pin 50. The cam 52 in the illustrated embodiment is formed as a wheel 54 pivotally disposed within a slot 56 formed in the first end 46 above the aperture 48, as best shown in FIG. 5, but could be formed as a static member, or as a curved portion of the cover 44 adjacent the first end 46. The wheel 54 is rotatably mounted on a shaft 58 extending across the slot 56, such that the wheel 54 can rotate freely within the slot 56. In the open position shown in FIG. 6, the compressed gas canister 20 can be positioned within the compartment 38 and engaged with the arm 36 of the reset switch 28. When the cover 44 is pivoted to the closed position shown in FIGS. 3-5, the wheel 54 is urged upwardly into contact with the bottom of the cartridge 20. Continued movement of the cover 44 towards the magazine 10 simultaneously presses the canister 20 against the arm 36 of the switch 28 and moves the spout 60 of the canister 20 into engagement with a valve mechanism 62 disposed within the compartment 38. In the closed position for the cover 44 shown in FIG. 5, a locking arm 64 on the cover 44 spaced near a second end 47 engages a complementary structure disposed within the compartment 38 in order to hold the cover 44 securely over the compartment 38, and the wheel 54 functions to maintain the canister 20 in secure engagement with the valve mechanism 62 and the arm 36 during use of the magazine 10, whether engaged with a weapon 100 or not.

As the cover 44 is closed over the compartment 38, the spout 60 of the canister 20 is urged into the inlet 61 of a housing 63 for the valve mechanism 62 for engagement with a piercing device 64 and a surrounding seal 66 to open the canister 20 and prevent gas from escaping out of the valve mechanism 62. Above the piercing device 64, the valve mechanism 62 includes shuttle valve 68 that can move along a channel 70 formed in the housing 63 between the piercing device 64 and an outlet 72 located opposite the inlet 61. The outlet 72 includes a pair of sealing members 73 therein which are engaged by the valve stem 118 of the weapon 100 when the magazine 10 is engaged within the sleeve 120 of the weapon 100. When the stem 118 is inserted into the outlet 72, the stem 118 is sealingly engaged with the sealing members 73 and presses the shuttle valve 68 towards the canister 20 against the pressure of the gas in the canister 20 to fluidly connect the canister 20 to the valve 116 in the weapon 100.

To hold the housing 63 in position within the compartment 38, the housing 63 includes a wide lower section 74 in which the inlet 61 is located, and a narrow upper section 76 that seats within an opening 77 formed in the compartment 38 at the engagement end 31 of the magazine 10. The upper section 76 includes a peripheral flange 78 that is positioned against the exterior of the magazine 10 to align the housing 63 within the compartment 38.

When the weapon 100 is fired, the actuation of the trigger 108 causes the control module 110 to operate the valve 116 to release an amount of the compressed gas from the canister 20 through the valve 116, providing an audible "pop" to signal the firing of the simulated ammunition round. The activation of the valve 116 can be done in a single shot, semi-automatic or fully automatic manner, depending upon the type of simulated weapon 100 being used. In an alternative embodiment for the magazine 10, the "pops" from the release of the compressed gas from the canister 20 can be generated directly by the valve mechanism 62 in the magazine 10, as opposed to by the mechanism 116 in the weapon 100, such that the mechanism 116 is not required and can be omitted.

Figure 3:
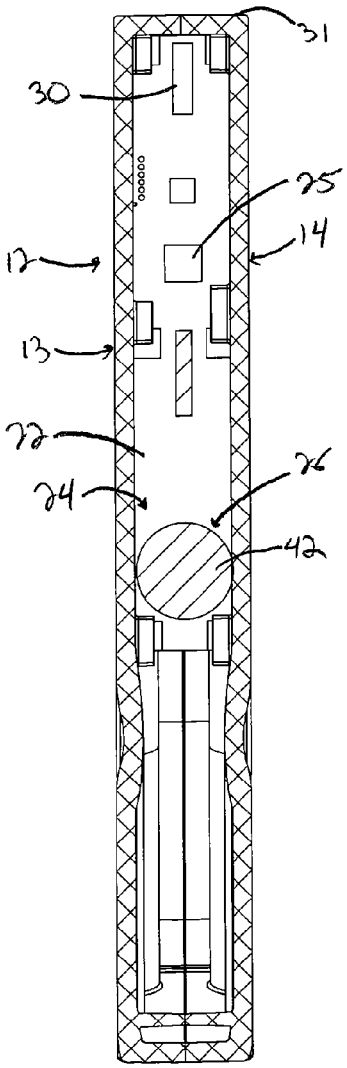
FIG. 3 is cross-sectional view along line 3-3 of FIG. 2.
Figure 2:
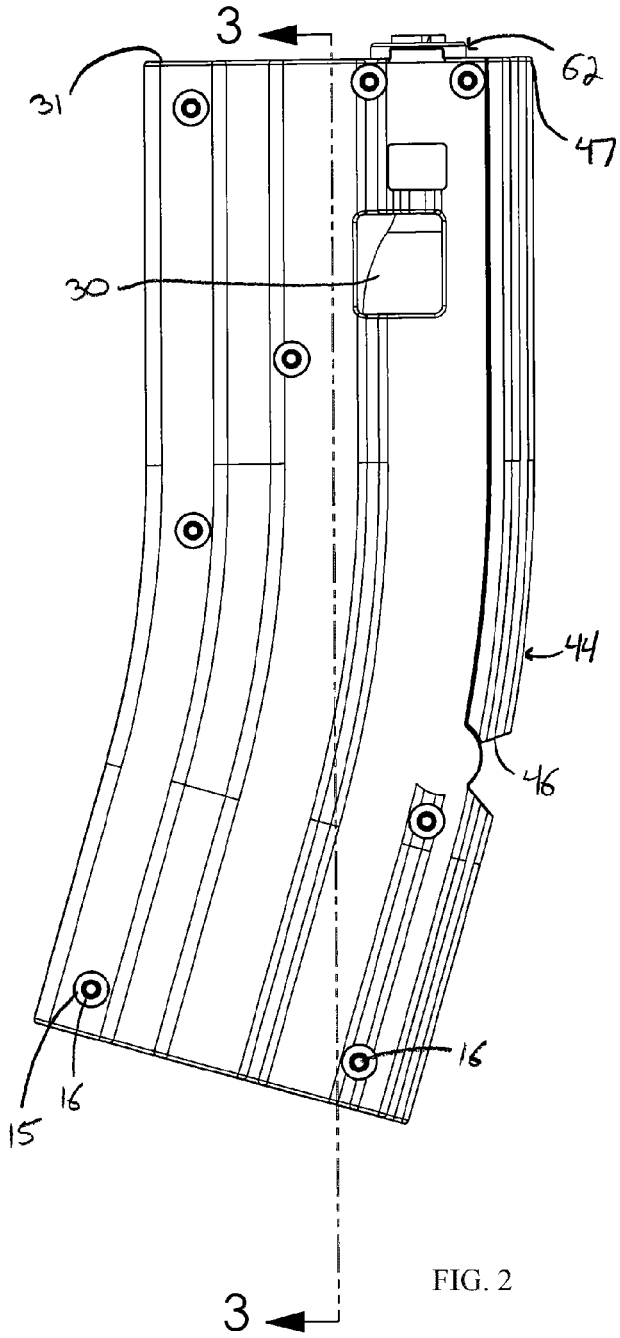
FIG. 2 is a side plan view of the magazine of FIG. 1.
Figure 4:
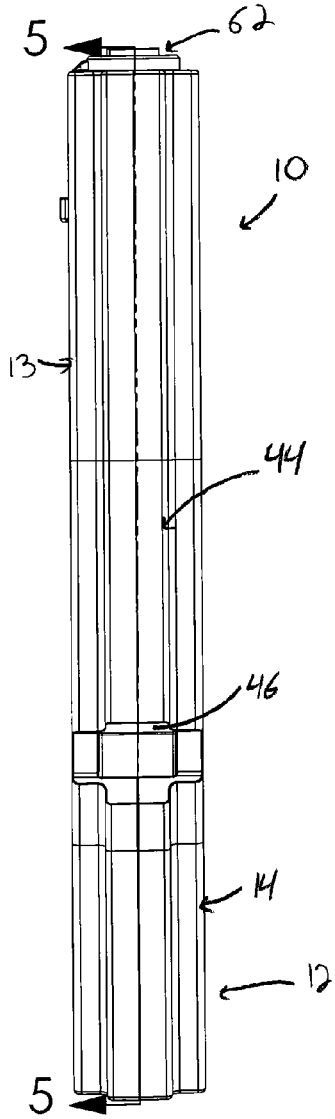
FIG. 4 is a front plan view of the magazine of FIG. 1.
Figure 6:
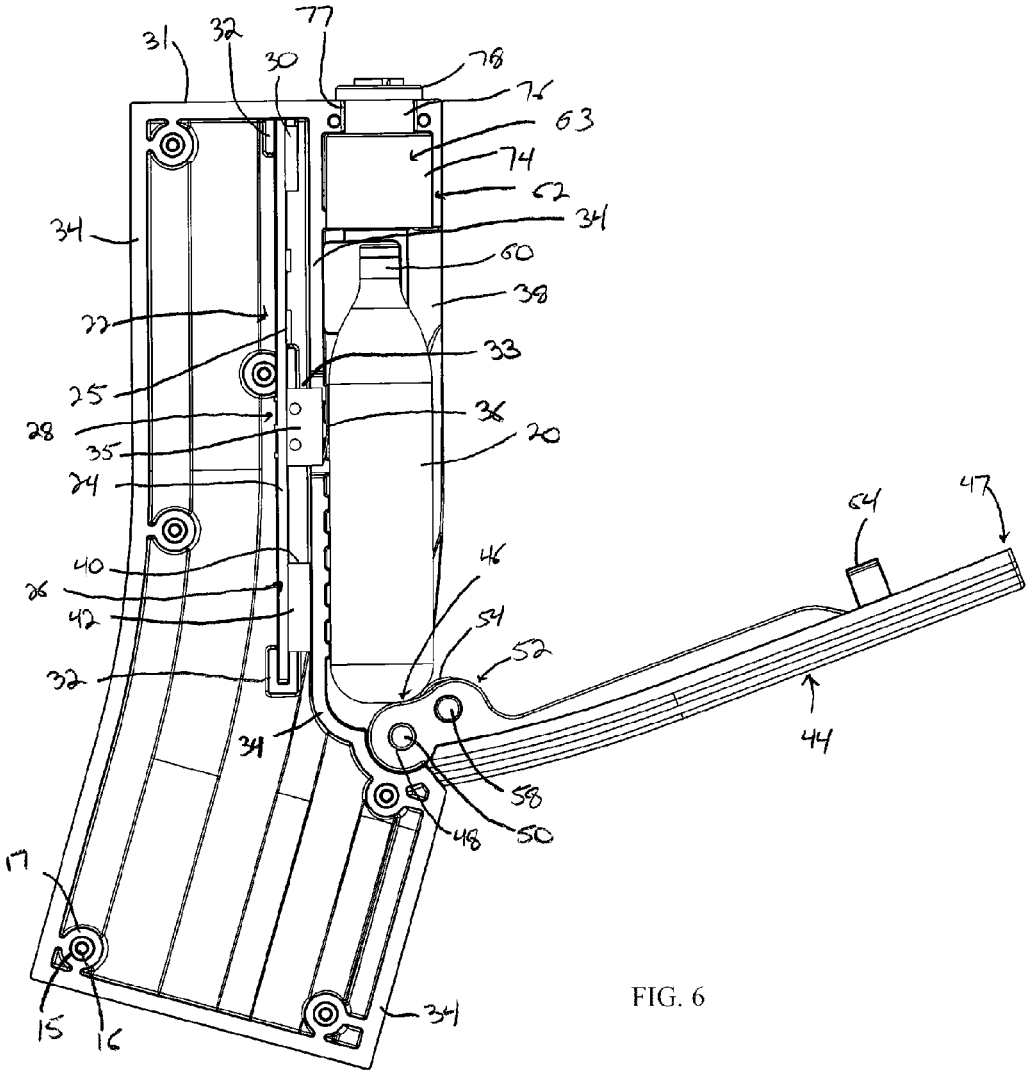
FIG. 6 is a cross-sectional view of the magazine of FIG. 1 in an open configuration.
Figure 7:
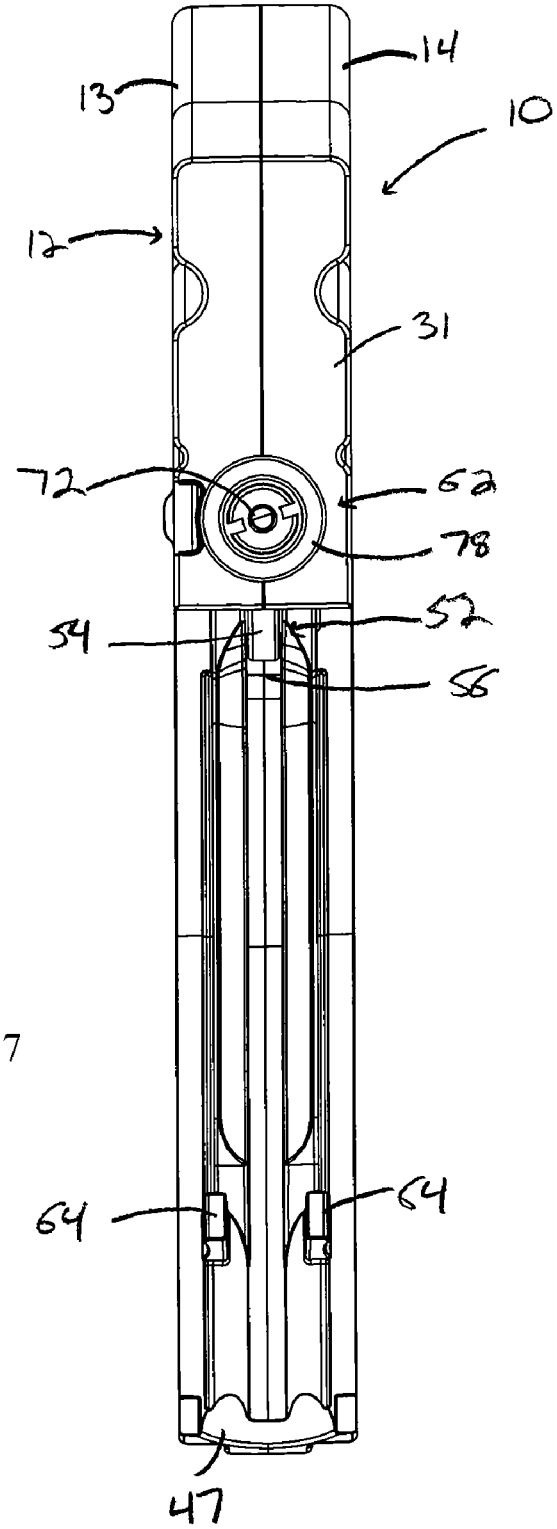
FIG. 7 is a top plan view of the magazine of FIG. 6.

In use, during assembly of the magazine 10, the storage medium 25 is formatted for use with a particular type of weapon 100, such that upon any reset of the data module 22, the storage medium 25 will be reset to the selected value for the maximum number of "shots" available in the magazine 10. Power to enable the storage medium 25 to store and retain this information when the magazine 30 is not connected to the weapon 100 is provided by the battery 42 engaged with the storage medium 25 via the board 24. The magazine 10 can then be loaded with the cartridge 20. To do so, the cover 44 is pivoted away from the magazine 10 to expose the compartment 38, as shown in FIG. 6. The cartridge 20 is subsequently positioned within the compartment 38 with the spout 60 adjacent the valve mechanism 62 and the cover 44 is moved to the closed position, as shown in FIGS. 3-5.

In closing the cover 44 over the cartridge 20, the wheel 54 engages the cartridge 20 opposite the spout 60 and presses the cartridge both upwardly into the inlet 61 of the valve mechanism 62 and inwardly against the arm 36 of the reset switch 28. By depressing the arm 36, the data module 22 and storage medium 25 are reset/activated to indicate that the magazine 10 has a full amount of "shots" corresponding to the value written to the storage medium 25. This amount can be viewed on the display 30 on the magazine 10. When the cover 44 is locked into engagement with the compartment 38 via the arm 64, the canister 20 is fully compressed against the switch arm 36 and inserted into the valve mechanism inlet 61. In this position, the compressed gas in the canister 20 urges the shuttle valve 68 upwardly to close the mechanism 62 and prevent gas from escaping the magazine 10.

After loading the cartridge 20, the magazine 10 can be inserted within the sleeve 120 of the weapon 100. When inserted, the stem 118 of the valve mechanism 116 in the weapon 100 enters the outlet 72 to move the shuttle valve 68 against the pressure of the compressed gas to enable the gas to flow past the shuttle valve 68 and into the mechanism 116.

Additionally, the connector 30 is positioned in magnetic connection with a suitable member (not shown) in the sleeve 120 to operably connect the connector 30 and data module 20 with the control module 110 within the weapon 100. The magazine 10 can be held in the engaged position within the sleeve 120 by the locking mechanism (not shown) disposed on the sleeve 120 that releasably engages the magazine 10.

When the weapon 100 is in use, the individual depresses the trigger 108 to fire one or more "shots" from the weapon 100. In doing so, the individual operates the control module 110 which send a signal to the data module 22 via the magnetic connector 30. This signal modifies the storage medium 25 to change the number of remaining "shots" in the magazine in accordance with the number of "shots" that have been fired. As the storage medium 25 is rewritten with the "shots" that have been fired by the weapon 100, the data module 22 sends return signals to the control module 110 such that the control module 110 can illustrate the number of "shots" remaining in the magazine 10 on a suitable display (not shown) on the weapon 100. If the number of "shots" remaining within the magazine 10 as stored in the storage medium reaches zero, then the control module 110 in the weapon 100 receives a corresponding signal from the data module 22 that causes the control module 110 to prevent further operation of the weapon 100.

Once empty, the magazine 10 needs to be removed from the weapon 100 and either replaced with another magazine 10 or by removing and replacing the canister 20 in the empty magazine 10. To do so, the cover 44 is pivoted away from the compartment 38 to enable the empty canister 20 to be pulled out of the valve mechanism 62 and removed from the compartment 38 in order to be replaced by a fresh or full cartridge 20. Once the empty cartridge 20 is removed, the arm 36 of the reset switch 28 is allowed to extend away from the switch 28. The switch 28 can be reset when the full cartridge 20 is placed within the compartment 38 and engaged by the cover 44 as described previously. This sends a signal to the data module 22 to reset the value of the number of "shots" remaining in the magazine to the full predetermined amount for the magazine 10 as contained in the storage medium 25, thereby rendering the magazine 10 fully loaded.

Further, if the magazine 10 is removed from the weapon 100 prior to having all of the "shots" fired, the number of "shots" remaining in the magazine 10 is maintained on the storage medium 25 as a result of the power supplied by the battery 42 to the data module 22. Therefore, the magazine 10 can be reinserted into the weapon 100 or into another weapon 100 and provide the same number of "shots" that remained when the magazine 10 was initially removed from the weapon 100.

As the weapon 100 is fired using the trigger 108, the control module 110 operates the valve mechanism 116 in the weapon 100. The mechanism 116 allows for an amount of compressed gas to escape the magazine 10 in a manner that produces an audible "pop" corresponding to the "shot" that was fired. In one embodiment of the magazine 10, the maximum number of "shots" contained in the magazine 10 is less than the number of "pops" that can be obtained from the cartridge 20. In this manner, the magazine 10 ensures a full number of "pops" to accompany each "shot" that is taken.

In still another embodiment, the magazine 10 can be constructed to accommodate multiple cartridges 20 within one or more compartments 38 having one or more switches 28 and valve mechanisms 62 therein to be engaged by the cartridges 20 for use with weapons 100 having larger ammunition capacities.

Various other embodiments of the present invention are contemplated as being within the scope of the filed claims particularly pointing out and distinctly claiming the subject matter regarded as the invention.

The invention claimed is:

1. A simulated magazine adapted to be releasably detached for use with a simulated weapon, the magazine comprising:

a) a shell;

b) a data module positioned within the shell and including an electronic storage medium for storing information on an amount of simulated ammunition remaining in the magazine, and a connector operably connected to the storage medium and adapted to be operably connected to a control module in the weapon to transmit to and receive signals with the control module in response to the operation of the weapon for adjusting the information stored in the storage medium concerning the amount of ammunition remaining in the magazine;

c) a cover pivotally connected to the shell to selectively engage the shell and enclose a compartment adapted to receive a compressed gas canister; and d) a cam disposed on the cover, wherein the cam is adapted to urge the compressed gas canister into secure engagement within the compartment when the cover is engaged with the shell.

2. The magazine of claim 1 further comprising a valve mechanism positioned at least partially within the compartment of the shell, the valve mechanism including an inlet for receiving a spout of a compressed gas canister.

3. The magazine of claim 2 further comprising an outlet for the valve mechanism adapted to be connected to the weapon.

4. The magazine of claim 2 wherein the valve mechanism is adapted to produce an audible "pop" in response to operation of the weapon when connected to the compressed gas canister.

5. The magazine of claim 1 further comprising a reset switch operably connected to the data module and disposed at least partially in the compartment.

6. The magazine of claim 5 wherein the reset switch comprises:

a) a base operably connected to the data module; and b) an arm extending outwardly from the base into the compartment, wherein the arm is adapted to be engaged with the compressed gas canister.

7. The magazine of claim 1 further comprising a valve mechanism positioned at least partially within the compartment of the shell, the valve mechanism including an inlet for receiving a spout of a compressed gas canister, wherein the cam is adapted to urge the canister into engagement with the valve mechanism when the cover is engaged with the shell.

8. The magazine of claim 1 further comprising a reset switch operably connected to the data module and disposed at least partially in the compartment; wherein the cam is adapted to urge the canister into engagement with the reset switch when the cover is engaged with the shell.

9. The magazine of claim 1 wherein the cam comprises a wheel rotatably mounted to the cover.

10. The magazine of claim 1 wherein the cam is adapted to urge the canister inwardly and upwardly with respect to the compartment.

11. The magazine of claim 1 wherein the connector is adapted to receive power from the weapon to operate the data module.

12. The magazine of claim 1 wherein the connector is completely enclosed within the shell.

13. The magazine of claim 1 further comprising a power source disposed within the shell and operably connected to the data module.

14. A method of tracking the number of simulated ammunition "shots" fired from a simulated weapon, the method comprising the steps of:

a) providing a simulated magazine including a shell, a data module positioned within the shell and including an electronic storage medium for storing information on an amount of simulated ammunition remaining in the magazine, and a connector operably connected to the storage medium and adapted to be operably connected to a control module in the weapon to transmit to and receive signals with the control module in response to the operation of the weapon for adjusting the information stored in the storage medium concerning the amount of ammunition remaining in the magazine and a cover pivotally connected to the shell to selectively engage the shell and enclose a compartment adapted to receive a compressed gas canister, and a cam disposed on the cover, wherein the cam is adapted to urge the compressed gas canister into secure engagement within the compartment when the cover is engaged with the shell;

b) inserting the magazine within weapon to operably connect the data module with the control module of the weapon via the connector;

c) transmitting signals between the data module and the control module in response to the operation of the weapon to change the information stored in the storage medium regarding the number of simulated ammunition "shots" in the magazine.

15. The method of claim 14 further comprising the steps of:

a) removing the magazine from the weapon when the number of simulated ammunition shots within the magazine reaches zero;

b) opening the cover of the shell to expose the compartment; and c) replacing the compressed gas canister in the compartment.

16. The method of claim 15 wherein the step of replacing the canister within the compartment comprises the steps of:

a) removing the canister from the compartment; and b) inserting a full canister into the compartment to engage a reset switch positioned within the compartment.

17. The method of claim 16 wherein the step of inserting the full canister into the compartment comprises the steps of:

a) placing the fresh canister within the compartment in engagement with a cam disposed on the cover; and b) closing the cover over the compartment to cause the cam to urge the canister upwardly and inwardly into the compartment to engage the switch.

18. The method of claim 14 further comprising the step of releasing an amount of gas from the canister in response to operation of the weapon to produce an audible "pop" within the shell or the weapon.

* * * * *